US011678725B2

(12) United States Patent
Giger

(10) Patent No.: US 11,678,725 B2
(45) Date of Patent: Jun. 20, 2023

(54) FOLDING CLASP FOR A WRIST WATCH AND METHOD FOR RETROFITTING SAME

(71) Applicant: Richemont international SA, Villars-sur-Glâne (CH)

(72) Inventor: David Giger, Beringen (CH)

(73) Assignee: Richemont International SA, Villars-sur-Glane (CH)

( * ) Notice: Subject to any disclaimer, the term of this patent is extended or adjusted under 35 U.S.C. 154(b) by 274 days.

(21) Appl. No.: 17/051,774

(22) PCT Filed: May 8, 2019

(86) PCT No.: PCT/IB2019/053774
§ 371 (c)(1),
(2) Date: Oct. 30, 2020

(87) PCT Pub. No.: WO2019/229559
PCT Pub. Date: Dec. 5, 2019

(65) Prior Publication Data

US 2021/0196006 A1 Jul. 1, 2021

(30) Foreign Application Priority Data

May 31, 2018 (CH) ..... CH00692/18

(51) Int. Cl.
*A44C 5/24* (2006.01)
*A44B 11/22* (2006.01)

(52) U.S. Cl.
CPC ..... *A44B 11/223* (2013.01); *A44C 5/246* (2013.01)

(58) Field of Classification Search
CPC ..... A44B 11/223; A44C 5/246
See application file for complete search history.

(56) References Cited

U.S. PATENT DOCUMENTS 280,319 A * 6/1883 McCloskey et al. ..... A44B 11/226 24/166
766,500 A * 8/1904 Hatfield ..... A44B 17/0011 24/669

(Continued)

FOREIGN PATENT DOCUMENTS

EP 2997847 A1 3/2016
FR 2699796 A1 7/1994

(Continued)

OTHER PUBLICATIONS

International Search Report for PCT/IB2019/053774, dated Aug. 8, 2019, 2 pages.

*Primary Examiner* — Jason W San
(74) *Attorney, Agent, or Firm* — Blank Rome LLP

(57) ABSTRACT

A folding clasp for a wrist watch comprising a first bracket (3) and a second bracket (4), wherein the first bracket (3) has a first securing mechanism (6) for securing a wristband or a watch housing of the wrist watch, wherein the second bracket (4) has a second securing mechanism (7) for securing the wristband (2) of the wrist watch, wherein the first bracket (3) and the second bracket (4) are moveably connected to one another, such that the first and the second brackets (3, 4) can be moved relative to one another between an open state and a closed state of the folding clasp (1), wherein the folding clasp has a locking mechanism (9) in order to retain the first and the second brackets (3, 4) in the closed state, wherein the second securing mechanism (7) has a protruding pin (74) which is designed to be guided through the wristband (2) in order to secure the wristband in various axial positions in the second securing mechanism (7), wherein the second securing mechanism (7) has a blocking means (8) which is designed to retain the distal end of the pin (74) guided through the wristband (2) such that the wrist- (Continued)

band is blocked on the pin (74) in the open state of the folding clasp (1).

22 Claims, 2 Drawing Sheets

(56) References Cited

U.S. PATENT DOCUMENTS 1,203,771 A * 11/1916 Nichols ..... A44B 11/2561 24/628
1,511,665 A * 10/1924 Faulkner ..... A44B 11/223 24/180
2,082,621 A * 6/1937 Eklund ..... A44C 5/24 224/176
2,513,592 A * 7/1950 Silverman ..... A44C 5/2047 24/616
2,732,581 A * 1/1956 Heck ..... E05D 5/10 16/257
3,425,104 A * 2/1969 Mochizuki ..... A44C 5/2042 24/311
3,797,716 A * 3/1974 Mochizuki ..... A44C 5/24 224/176
4,477,949 A * 10/1984 Calabro ..... A44B 11/223 24/186
4,541,151 A * 9/1985 Herchenbach ..... A44C 5/2057 24/174
4,928,359 A * 5/1990 Gagnebin ..... A44C 5/2042 24/DIG. 46
5,313,691 A * 5/1994 Hashimoto ..... A44C 5/2052 24/69 J
5,485,659 A * 1/1996 Kashikie ..... A44C 5/246 24/71 J
5,564,131 A * 10/1996 Anscher ..... A44B 11/2592 24/669
5,787,554 A * 8/1998 Hashimoto ..... A44C 5/2052 24/71 J
5,829,104 A * 11/1998 Gay ..... A44C 5/24 24/71 J
6,360,404 B1 * 3/2002 Mudge ..... A01K 27/005 24/115 F
6,944,916 B2 * 9/2005 Kawagoe ..... A44C 5/246 24/70 J
8,935,834 B2 * 1/2015 Mouche ..... A44C 5/24 224/164
9,526,305 B2 * 12/2016 Granito ..... A44C 5/22
9,591,899 B2 * 3/2017 Catanese ..... A44B 11/226
10,085,528 B2 * 10/2018 Wong ..... A44C 5/22
10,149,520 B2 * 12/2018 Mace ..... A44C 5/185
10,278,460 B2 * 5/2019 Catanese ..... A44C 5/246
D888,258 S * 6/2020 Boon ..... D24/190
D906,872 S * 1/2021 Giger ..... D11/94
10,932,532 B2 * 3/2021 Vuilleme ..... A44C 5/24
11,013,301 B2 * 5/2021 Yang ..... A44C 5/24
11,051,593 B2 * 7/2021 Catanese ..... A44C 5/2057
11,445,788 B2 * 9/2022 Viller ..... A44C 5/18
2004/0083581 A1 * 5/2004 Kawagoe ..... A44C 5/185 24/265 WS
2006/0207067 A1 * 9/2006 Maillard ..... A44C 5/14 24/265 WS
2009/0241597 A1 * 10/2009 Robert ..... A44C 5/246 63/3.2
2012/0110792 A1 * 5/2012 Granito ..... A44C 5/246 24/265 EC
2014/0223705 A1 * 8/2014 Catanese ..... A44C 5/246 24/71 J
2017/0215531 A1 * 8/2017 Wong ..... A44C 5/22
2021/0022457 A1 * 1/2021 Schaller ..... A44C 5/246
2022/0295951 A1 * 9/2022 Granito ..... A44C 5/246

FOREIGN PATENT DOCUMENTS

GB 2278148 A 11/1994
JP 2006/115992 A 5/2006

* cited by examiner

FOLDING CLASP FOR A WRIST WATCH AND METHOD FOR RETROFITTING SAME

RELATED APPLICATIONS

This application is a national phase application of PCT/IB2019/053774, filed May 8, 2019, which claims the benefit of Swiss Patent Application No. CH00692/18, filed on May 31, 2018. The entire contents of these applications are hereby incorporated by reference.

TECHNICAL FIELD

The invention relates to a folding clasp, to a wristwatch having such a folding clasp, and to a method for retrofitting such a folding clasp.

PRIOR ART

The ends of straps of wristwatches are usually connected to pin buckles or folding clasps in order to be fastened normally on the wearer's arm. The folding clasp has an open state with a large opening circumference and closed state with a small opening circumference. The fastening position of the strap on the folding clasp allows the small opening circumference to be adjusted to the circumference of the wearer's arm. The subsequent opening or closing action thus allows the opening circumference of the strap to be increased or decreased in size straightaway to the adjusted positions, without the wearer having to do anything else, in order for the wristwatch to be removed from the arm or fixed thereon. The overwhelming advantage is that, when the folding clasp is open, the wristwatch cannot fall off the wrist in an unchecked manner or without being noticed. Since the wristwatch forms a closed ring, even in the open state, the wristwatch can only be removed over the hand. Should the folding clasp open accidentally, then, when the arm is hanging downward, the wristwatch only slips over the wearer's wrist, which usually allows the watch to be caught. In the case of a pin buckle, in contrast, the watch falls off the arm in an unchecked manner. Furthermore, such folding clasps have the advantage that, in comparison with the pin buckles mentioned in the introduction, straps are not kinked to such an extent and therefore remain intact over a longer period of time, which is not just cost-effective, but is advantageous in respect of the aesthetic requirement of the watch, in particular those in the high-price category. If folding clasps are used with flexible watch straps, e.g. those made of leather, rubber, textile material or those in the form of Milanese watch straps, then it is often the case that one end of the watch strap is fixed to a first end of the folding clasp and a second end of the watch strap is connected to the second end of the folding clasp in an adjustable axial position, in order for the circumference of the watch strap to be adjusted when the folding clasp is in the closed state. For the purpose of fastening the axial position of the second end of the watch strap at the second end of the folding clasp, the latter often has a pin, which in the desired position extends through the watch strap. The problem here, however, is that, on account of natural arm movements of the wearer and in dependence on the wearing conditions and also on the environment, the flexible watch strap, depending on the quality of the strap, softens and wears to a greater or lesser, but unavoidable, extent over a relatively long period of time, which is evident particularly in the case of natural materials such as, for example, leather. The watch strap loses for example stiffness in the vicinity of said position and/or the holes through which the pin can be guided become stretched. This can result in the situation where, when the folding clasp is open, the pin slips accidentally out of the watch strap and, as in the case of pin buckles, the wristwatch thus falls from the wrist in an unchecked manner or without being noticed, and the folding clasp no longer serves the important purpose of preventing an unintentional dropping of the wristwatch, unless the strap in question is replaced with a new one in good time.

DESCRIPTION OF THE INVENTION

It is the object of the invention to find a folding clasp which can fix a flexible watch strap reliably in a plurality of axial adjustment positions.

This object is achieved according to the invention by a folding clasp having a pin for fixing the axial position of a flexible watch strap, and having a blocking means. The blocking means is designed so that the end of the pin guided through the watch strap is thereby retained such that, in the open state of the folding clasp, the watch strap remains blocked on the pin.

This has the advantage that the pin is effectively prevented from slipping out of the watch strap when the folding clasp is in the open state. At the same time, the existing mechanism of the folding clasp has to be modified only to a slight extent, since all that is required is for the blocking means to be added. This also allows existing folding clasps to be retrofitted in a straightforward and very effective manner in order for said problem to be overcome.

Further advantageous embodiments are specified in the dependent claims.

In one exemplary embodiment, the second fastening mechanism is fastened on the second bracket such that it can be rotated about an axis of rotation. The second fastening mechanism and the second bracket are preferably mounted on a shaft running along the fastening axis such that they can be rotated relative to one another. The blocking means is preferably mounted on the shaft such that it can be rotated in relation to the pin and/or to the second bracket. This has the advantage that the fastening mechanism does not require much modification. It is sufficient for the existing mechanism to have a blocking means mounted in a rotatable manner on the shaft. This particularly straightforwardly creates a blocking means which can rotate in relation to the second bracket and/or is arranged in a rotatable manner in relation to the pin. The latter allows the blocking means to move between a blocking state and a released state.

In one exemplary embodiment, the blocking means has a blocking opening, which is designed to accommodate, and to retain, the distal end of the pin. The blocking opening is preferably formed by two leaf-spring elements arranged opposite one another.

In one exemplary embodiment, the blocking opening is formed by two leaf-spring elements arranged opposite one another. This makes it possible, by virtue of the distal end of the pin being pushed lightly against the blocking opening, and therefore counter to the spring force, for said blocking opening to be opened somewhat and the distal end of the pin to be latched in. The two leaf-spring elements are preferably formed from the same leaf spring. The blocking means preferably forms at least one eyelet for the rotatable mounting of the leaf-spring element on a shaft made of the same leaf spring. This has the advantage that the blocking means can be formed in one piece and is therefore straightforward to manufacture. At the same time, the blocking mechanism is particularly straightforward and effective as result of the spring action of the leaf spring. Along the longitudinal axis of the watch strap or from the eyelet to the blocking opening, the blocking means or the leaf spring preferably has an amount of curvature which is such that, in the blocked state, the distal end of the pin protrudes from the concave side and/or the convex side is oriented toward the watch strap. This curvature improves the functionality of the blocking mechanism and/or better follows the shape of the bracket or brackets. In one exemplary embodiment, the second fastening mechanism has a frame for the watch strap, wherein the pin protrudes from the frame, wherein the frame has a first side, with the pin, and two lateral sides, wherein the pin protrudes from the first side of the frame in the direction of the second bracket, wherein the closure mechanism is independent of the blocking means, in order to retain the first and the second brackets in the closed state.

In one exemplary embodiment, the blocking means is arranged between the second bracket and the frame. In one exemplary embodiment, the blocking means is retrofitted on an existing folding clasp. The existing folding clasp preferably has a shaft, about which the second bracket and the second fastening mechanism are mounted such that they can be rotated relative to one another. Retrofitting involves the blocking means being fitted on the shaft such that the blocking means can be rotated relative to the pin and/or to the second bracket. This way of fitting the blocking means allows particularly straightforward retrofitting, which can easily be carried out even by a layperson.

BRIEF DESCRIPTION OF THE FIGURES

The invention will be explained in more detail with reference to the accompanying figures, in which.

WAYS OF IMPLEMENTING THE INVENTION

Figure 1:
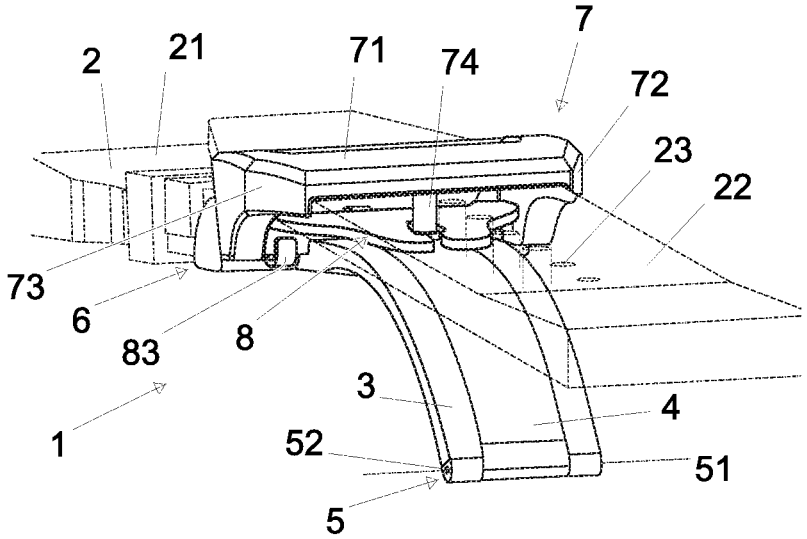
FIG. 1 shows a three-dimensional view of a first exemplary embodiment of the closed folding clasp, with a watch strap illustrated by dashed lines in a see-through state.
Figure 2:
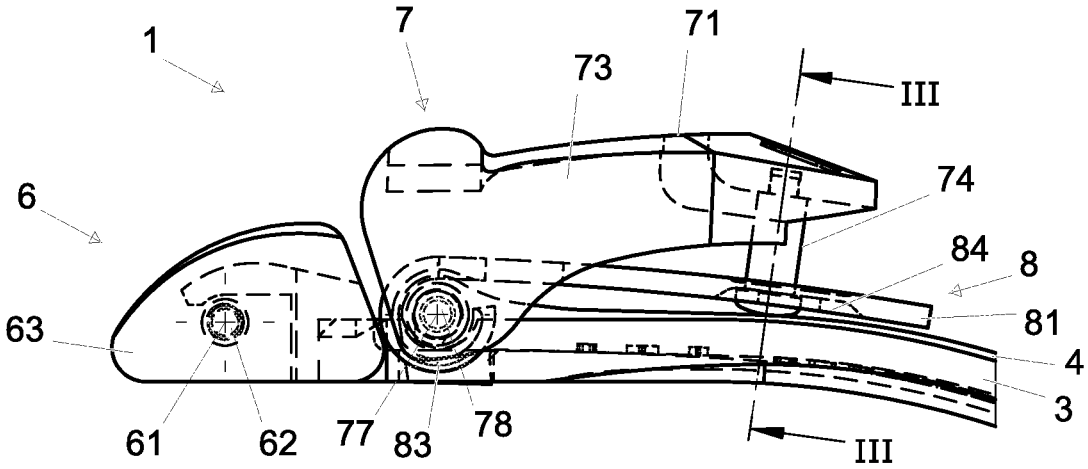
FIG. 2 shows a side view of a second exemplary embodiment of the closed folding clasp, without a watch strap.
Figure 3:
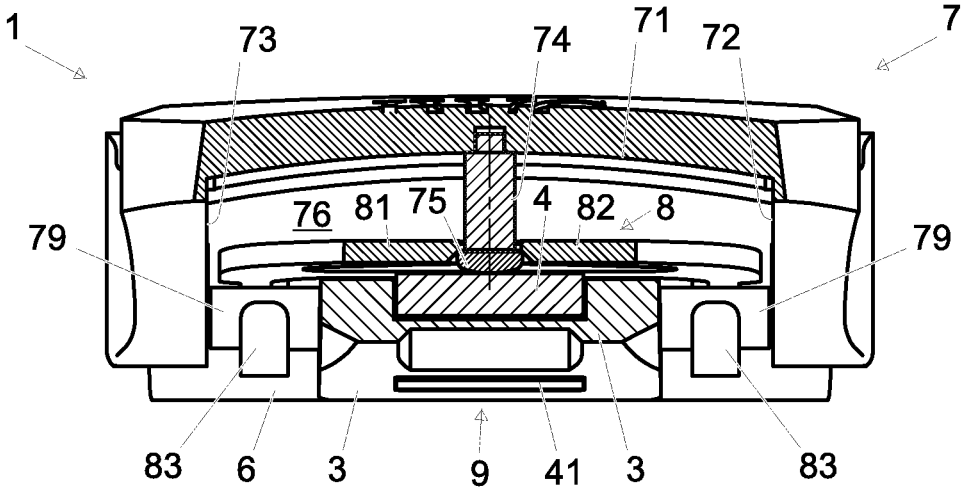
FIG. 3 shows a sectional view of the second exemplary embodiment of the closed folding clasp taken along line III-III from FIG. 2.

FIGS. 1 to 3 show two exemplary embodiments of the folding clasp 1 according to the invention. In FIG. 1, the watch strap is illustrated by dashed lines in a see-through state. FIGS. 2 and 3 illustrate the folding clasp 1 without a watch strap 22. FIG. 2 uses dashed lines to depict the concealed contours of the folding clasp 1.

The folding clasp 1 is preferably used in a wristwatch having the folding clasp 1, a watch housing, with a watch mechanism and/or electronic unit, and a watch strap 2. The folding clasp 1 is designed in the form of an opening mechanism for the wristwatch, in particular for flexible watch straps 2 produced, for example, from leather, textile material, rubber, plastic or in the form of flexible fine-link watch straps. Flexible fine-link watch straps can be produced, for example, from fine-mesh wire and form so-called Milanese watch straps. The folding clasp 1 is designed to connect the wrist strap 2 of the wristwatch to the folding clasp 1. The folding clasp 1 is preferably connected to a first side of the watch housing via a first watch strap 21 and to a second side of the watch housing via a second watch strap 22. However, it is also possible for the first watch strap 21 and the second watch strap 22 to be realized by a common or interconnected watch strap, which runs for example beneath the watch housing. It would also be possible, in theory, for the first side of the watch housing to be connected directly to the folding clasp 1, i.e. without a first watch strap 21 or a watch strap 2 between the first side of the watch housing and the folding clasp 1. The watch strap 2 preferably has two flat sides and two lateral sides. These four sides run preferably roughly parallel to the longitudinal axis or the axial direction of the watch strap. A lower flat side is directed toward the arm of the person wearing the wristwatch. An upper flat side, which is arranged opposite the lower flat side, is directed outward, i.e. away from the wearer's arm. The watch strap 2 has a first end and a second end. A first end of the watch strap 2 is connected to a first fastening mechanism 6 of the folding clasp 1, which will be described at a later stage in the text, or to the watch housing. The second end of the watch strap 2 is connected to a second fastening mechanism 7 of the folding clasp 1, which will be described at a later stage in the text, in differently adjustable fastening positions. The different adjustable fastening positions can be realized, for example, by holes 23 in the watch strap 2. The second end of the watch strap 2 is realized preferably by a second end of the second watch strap 22, wherein the first end of the second watch strap 22 is connected to the watch housing. The first end of the watch strap 2 is realized preferably by a first end of the first watch strap 21, wherein the second end of the first watch strap 21 is connected to the watch housing. If the watch strap 2 is fastened in the second fastening mechanism 7 and the watch strap 2 or the watch housing is connected to the first fastening mechanism 6 of the folding clasp, then the watch housing, the watch strap 2 and the folding clasp 1 form a closed ring. The axial direction or the longitudinal axis of the watch strap 2 or of the folding clasp 1 is intended to denote here the circumferential direction of said ring.

The folding clasp 1 is designed to be moved between an open state and a closed state. Said ring has a larger diameter in the open state than in the closed state. This is achieved in that the distance between the first and second fastening mechanisms 6 and 7 is smaller in the closed state than in the open state. In the open state with the larger circumference, the wristwatch can be straightforwardly guided over the hand onto the forearm. In the closed state, the circumference is decreased in size, and therefore the wristwatch no longer fits over the hand and is thus blocked in this state. Adjustment of the axial fastening position in the second fastening mechanism 7 allows the circumference of the ring or of the wristwatch to be adjusted to the circumference of the wearer's wrist. Both in the open state and in the closed state, therefore, the above described ring of the wristwatch remains closed (provided the watch strap 2 is connected to the folding clasp 1). It is only when the watch strap 2 is removed from the second fastening mechanism 7 (or also the first fastening mechanism 6) that the ring is opened.

The folding clasp 1 has a first bracket 3 and a second bracket 4.

The first bracket 3 has a first end and a second end. The first bracket 3 has a longitudinal axis. The longitudinal axis extends preferably along the longest side and/or from the first end to the second end. The first bracket 3 preferably has two flat sides and two lateral sides. A lower flat side is directed toward the arm of the person wearing the wristwatch. An upper flat side, which is arranged opposite the lower flat side, is directed outward, i.e. away from the wearer's arm. The first bracket 3 is formed preferably such that it follows a slight curvature. The two flat sides are preferably curved. As result, the first bracket 3 or the folding clasp 1 better follows the shape of the arm of the person wearing the wristwatch and/or the first bracket 3 has a level of spring stressing which can be used for the closing mechanism of the folding clasp 1. The first bracket 3 is arranged in the folding clasp 1 preferably in such a way that, when the folding clasp 1 is in the closed state, the first bracket rests on the wearer's arm. The first bracket 3 preferably has an aperture, in which the second bracket 4 is accommodated. This aperture is preferably arranged on the upper side of the first bracket 3 and does not pass right through. However, it is also possible for the aperture to pass some or all of the way through, and therefore the (upper and lower) flat side of the bracket 3 is formed by two cross-pieces. It is also possible for the two brackets 3 and 4, instead of having an aperture, to be arranged one beside the other.

The first bracket 3 has a first fastening mechanism 6 for fastening on a wristwatch. The first fastening mechanism 6 is preferably designed to fasten the watch strap 2 of the wristwatch, preferably the first watch strap 22 of the wristwatch. The first fastening mechanism 6 is preferably designed to fasten the wristwatch or the watch strap 2 thereof such that its axial position is not adjustable (but fixed). The first fastening mechanism 6 is preferably realized by a shaft 62, which is mounted in the first fastening mechanism 6 and on which the watch strap 2, in particular a loop of the watch strap 2, can be mounted (in a rotatable manner). The shaft 62 is preferably a spring bar, which is mounted between two apertures in the side walls 63 of the first fastening mechanism 6. In this way it is possible for the shaft 62 to be straightforwardly removed, in order for the watch strap 2 or 21 to be fastened thereon, i.e. for the loop of the watch strap 2 or 21 to be pushed onto the shaft 62, and then for the shaft 62 to be fastened to the fastened watch strap 2 or 21 again. The longitudinal axis 61 of the shaft 62 extends preferably at right angles to the axial direction of the watch strap 2 and/or parallel to the flat side or sides of the watch strap 2. However, it would also be possible for the first fastening mechanism 6 to be configured in an adjustable manner, in which case the axial fastening position of the watch strap 2 can be adjusted in the first fastening mechanism 6 as well. The first fastening mechanism 6 is arranged preferably at the second end of the first bracket 3.

The first bracket 3 also has connecting means, in order to connect the first bracket 3 to the second bracket 4 in a movable manner, preferably rotatable manner, relative to one another. The connecting means is preferably an aperture, which is mounted on a shaft 52. The aperture is formed here by two lateral bearing points or bearing apertures. The aperture of the connecting means is preferably designed to mount a shaft 52 of which the longitudinal axis or axis of rotation 51 is arranged parallel to the shaft 62 or the longitudinal axis 61 thereof and/or to the shaft 78 or axis 77 and/or at right angles to the axial direction of the first bracket 3 and/or parallel to the flat sides of the first bracket 3. The connecting means is arranged preferably at the first end of the first bracket 3. However, it is also possible for the connecting means and/or the first fastening mechanism 6 not to be arranged at the first and/or second end. It is sufficient for the connecting means and the first fastening mechanism 6 to be spaced apart along the longitudinal axis of the first bracket 3.

The second bracket 4 has a first end and a second end. The second bracket 4 has a longitudinal axis. The longitudinal axis extends preferably along the longest side and/or from the first end to the second end and/or, when the folding clasp is in the closed state, basically parallel to the longitudinal axis of the first bracket 3 and/or of the watch strap 2. The second bracket 4 preferably has two flat sides and two lateral sides. The two flat sides and the two lateral sides preferably run parallel to the longitudinal axis of the second bracket 4. A lower flat side is directed toward the arm of the person wearing the wristwatch. An upper flat side, which is arranged opposite the lower flat side, is directed outward, i.e. away from the wearer's arm. The second bracket 4 is preferably formed such that it follows a slight curvature along the longitudinal axis. The two flat sides are preferably curved. The second bracket 4 or the folding clasp 1 thus better follows the shape of the arm of the person wearing the wristwatch and/or the second bracket 4 has a level of spring stressing which can be used for the closing mechanism of the folding clasp 1. The second bracket 4 is preferably arranged in the folding clasp 1 such that, when the folding clasp 1 is in the closed state, the second bracket is arranged on the first bracket 3 and/or in the aperture of the first bracket 3. It is also possible for the first bracket 3 to be arranged alongside the second bracket 4 when the folding clasp 1 is in the closed state.

The second bracket 4 has a second fastening mechanism 7 for fastening the watch strap 2, in particular the second watch strap 22, of the wristwatch. The second fastening mechanism 7 is designed to fasten the watch strap 2 or 22 in an adjustable manner in its axial fastening position. This makes it possible to adjust the length or the circumference of the wristwatch or of the ring (in the open and closed state of the folding clasp 1) formed by the watch housing, the watch strap and the folding clasp. For this purpose, the second fastening mechanism 7 has a protruding pin 74. The pin 74 is arranged and/or designed such that it can be guided through the watch strap 2, in order thus to fasten the watch strap 2 in its adjusted axial fastening position. The pin 74 protrudes from the second fastening mechanism 7 by way of a distal end of the pin 74. The distal end of the pin 74 can thus be guided, threaded, pushed or pierced through the watch strap 2. The second fastening mechanism 7 is preferably designed such that the watch strap 2 can be displaced in the axial direction through the second fastening mechanism 7, and/or the distal end of the pin 74 can be guided through from one flat side to the other flat side of the watch strap 2. The pin 74 is preferably arranged such that the distal end of the pin 74 is guided through from the upper flat side to the lower flat side in order to fasten the watch strap 2 in the second fastening mechanism 7. That is to say, when the folding clasp 1 is in the closed state, the distal end of the pin 74 is oriented basically in the direction of the first and/or second bracket 3, 4. This has the advantage that the blocking means, which will be described at a later stage in the text, is less conspicuous and/or is subjected to counter pressure by the second bracket 4 when the pin 74 is pushed against the blocking means 8. However, it is also possible for the pin 74 to be arranged such that the distal end of the pin 74 is guided through from the lower flat side to the upper flat side in order to fasten the watch strap 2 in the second fastening mechanism 7, and/or, when the folding clasp 1 is in the closed state, the distal end of the pin 74 is oriented basically away from the first and/or second bracket 3, 4. The second fastening mechanism 7 preferably has a frame. The frame has at least one side part or side wall, and preferably two side parts or side walls 72 and 73, which are located opposite one another and are connected by a connecting element or a connecting wall 71. The pin 74 preferably extends orthogonally in relation to the connecting element and/or parallel to the side walls 72 and 73. The pin 74 is preferably arranged in the center between the two side parts 72 and 73. The frame of the second fastening mechanism 7 is formed such that the lateral sides of the watch strap are guided parallel to the side walls 72 and 73 and the (upper) flat side of the watch strap are guided parallel to the connecting element 71. In the exemplary embodiment shown, the fourth side of the frame (opposite the connecting part 71) is preferably closed by the second bracket 4 and/or a shaft 78, which will be described at a later stage in the text, and therefore the fastening mechanism 7 (in this case together with the second bracket 4 or the shaft 78) forms a (preferably closed) through-passage, which allows only axial removal of the watch strap 2 from the second fastening mechanism 7 and/or does not allow the watch strap 2 to be guided laterally out of the second fastening mechanism 7. However, it would also be possible for the frame also to be closed on the fourth side or to allow the watch strap 2 to be guided laterally out of the second fastening mechanism 7. The pin 74 is preferably designed in a movable manner, and therefore the pin 74 (in this case together with the frame/second fastening mechanism 7) can be guided into the watch strap 2 (for the purpose of fixing the axial fastening position) and out of the watch strap 2 (for the purpose of releasing the axial position). The pin 74, preferably the frame/second fastening mechanism 7, is preferably connected in a movable manner, preferably in a rotatable manner, to the second bracket 4. The second bracket 4 is preferably mounted on a shaft 78, itself mounted in the frame or the second fastening mechanism 7, such that it can be rotated about the axis of rotation 77. The second fastening mechanism 7 or the frame thereof, in the side parts 72 and 73, preferably has apertures in which to mount the shaft 78. The shaft 78 thus extends between the two side walls 72 and 73. The second bracket 4 and the second fastening mechanism 7 are is thus arranged such that they can be rotated relative to one another (about the axis of rotation 77). The axis of rotation 77 or the longitudinal axis 77 of the shaft 78 is preferably parallel to the axis of rotation 51 and/or longitudinal axis 61 and/or to the shaft 52 and/or 62. The rotation of the second fastening mechanism 7, of the frame and/or of the pin 74 about the axis of rotation 77 allows the pin 74 to free and fasten the watch strap 2. The second fastening mechanism 7 is preferably arranged at the second end of the second bracket 4. The shaft 78 is preferably a spring bar, which is mounted between two apertures in the side walls 72, 73 of the second fastening mechanism 7.

The second bracket 4 has a connecting means, in order to connect the second bracket 4 to the first bracket 3 in a movable manner, preferably in a rotatable manner. The connecting means is preferably an aperture, which is mounted on the shaft 52. The aperture is designed in the form of a hole through the second bracket 4. The hole extends preferably at right angles to the longitudinal axis of the second bracket 4 and/or parallel to the flat sides of the second bracket 4 and/or from the first lateral side to the second lateral side. The connecting means is arranged preferably at the first end of the second bracket 4. However, it is also possible for the connecting means and/or the second fastening mechanism 7 not to be arranged at the first and/or second end. It is sufficient for the connecting means and the second fastening mechanism 7 to be spaced apart along the longitudinal axis of the second bracket 4.

The connection 5 of the first and second brackets 3 and 4 (via the connecting means thereof) allow the two brackets to move relative to one another. The folding clasp 1 is preferably designed to connect the first and second brackets 3, 4 to one another such that they can be rotated relative to one another. Rotation of the second bracket 4 in relation to the first bracket 3 (or vice versa) allows the second bracket 4 to be moved between an open and closed position. In the closed position, the second bracket 4 rests preferably on the first bracket 3 and/or is arranged at a minimal angle (in this case close to 0°) in relation to the first bracket 3. In this closed position, preferably the distance between the first fastening mechanism 6 and the second fastening mechanism 7 is smaller than in the open position, and is preferably minimal. In the open position, the angle is increased in size and therefore the distance between the first fastening mechanism 6 and the second fastening mechanism 7 is increased in size. At 180°, the circumference of the wristwatch should be increased in size by the sum of the two distances between the fastening mechanism 6 and 7 and the axis of rotation 51. In this case, the connection 5 is therefore designed in the form of a hinge.

The folding clasp 1 also has a closure means 9, which is designed to retain the folding clasp 1 in the closed state. In the exemplary embodiment shown here, the closure means 9 is a latch-in connection, which, when the brackets are pushed against one another, latches automatically into the closed position. The latch-in connection is opened usually by the brackets being pulled apart from one another by a force which has a value above an opening-threshold value. The latch-in connection is realized here by a positive shaped structure on the underside of the second bracket 3 and a corresponding aperture in the first bracket 4. The bending of the brackets 3, 4 causes the second bracket 4 to lengthen under pressure and thus to latch into the aperture of the first bracket 3. There are numerous alternative closure means for folding clasps 1 which are likewise possible here.

The exemplary embodiments depicted show a classic folding clasp. The invention which is described hereinbelow, however, can be used equally well for other types of folding clasp, for example for a butterfly clasp. In the case of the butterfly clasp, the first fastening mechanism would have, at the second end of the first bracket, a third bracket, which at its first end (like the second bracket 4) would be arranged (with an axis of rotation parallel to the axis of rotation 51) in a rotatable manner on the first bracket 3. The watch strap 2 or 21 would then be fastened at the second end of the third bracket.

The open and the closed state of the folding clasp 1 is achieved, as described above, preferably by rotation of the first and/or second bracket 3, 4. However, it is also possible to use other movements of the first and/or second bracket 3, 4 in the folding clasp 1 in order to move the latter back and forth between the open and closed state. This could also be achieved, for example, by a translatory movement or a combination of translatory movement and rotary movement.

Figure 4:
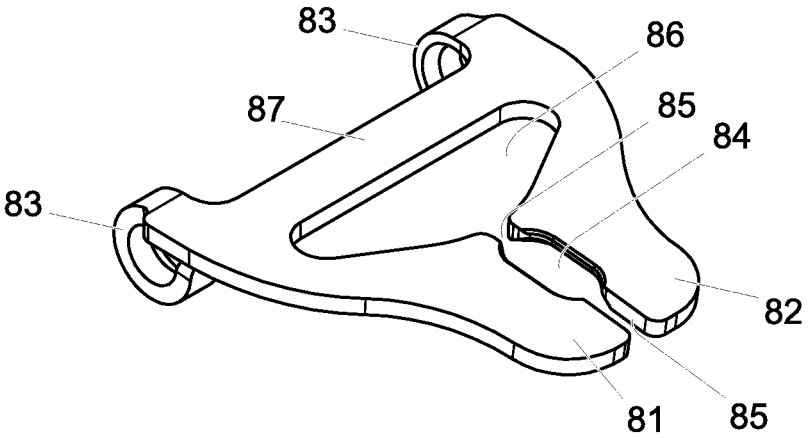
FIG. 4 shows a three-dimensional view of one exemplary embodiment of the blocking means.
Figure 5:
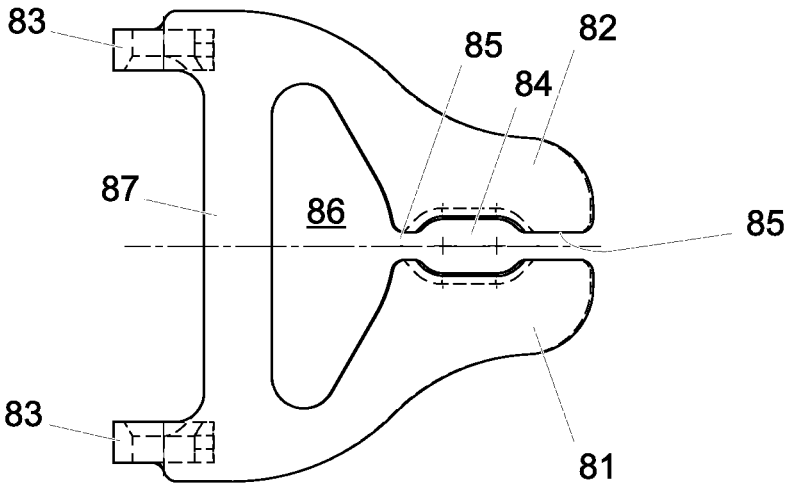
FIG. 5 shows a plan view of the exemplary embodiment of the blocking means.
Figure 6:
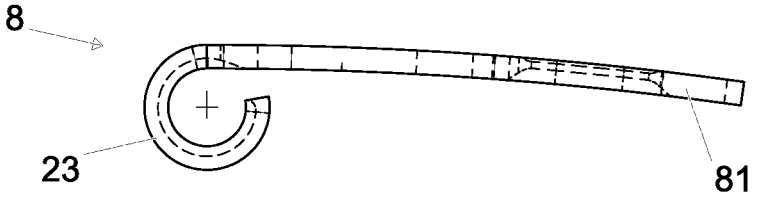
FIG. 6 shows a side view of the exemplary embodiment of the blocking means.

The second fastening mechanism 7, then, has the blocking means 8, which is designed to block the distal end of the pin 74 when the pin 74 extends through the watch strap 2 for the purpose of fixing the axial position of the watch strap 2. The blocking of the distal end of the pin 74 functions by way of a blocking mechanism of the blocking means 8, it being possible for said blocking mechanism to be designed in a large number of ways. It can be, for example, a latching mechanism, which, when a force is applied to the blocking means 8 or the pin 74 (in a certain direction), frees the pin 74 if the force exceeds a threshold value. The threshold value here can differ for different directions of force. However, the blocking mechanism can also have a closure mechanism, by means of which the pin 74 retained in the blocking means 8 is blocked until the closure mechanism is actuated or opened by the wearer. FIGS. 4 to 6 shows different views of an exemplary embodiment of a blocking means 8. FIGS. 5 and 6 use dashed lines to depict the concealed contours.

The blocking means 8 is arranged preferably in a movable manner in the second fastening mechanism 7. The blocking means 8 is arranged preferably in a movable manner relative to the frame and/or pin 74. This allows the blocking means 8 to be moved back and forth between a blocked state and a released state. The movement is preferably a rotation. The blocking means 8 is preferably arranged on the shaft 78, and therefore the blocking means 8 can be rotated about the same axis of rotation 77 as the pin 74 or as the frame. Depending on the design of the folding clasp 1, the rotatable arrangement of the blocking means 8 can be connected directly to the shaft 78 or connected indirectly through parts, which are arranged on the shaft 78. In this case, the blocking means is mounted, for example, on the spacers 79, which are in turn mounted on the shaft 78. The spacers 79 retain the second bracket 4 in the correct position between the side parts 72 and 73. It is thus possible to vary the angle between the blocking means 8 and the frame and therefore to vary the distance between the blocking means 8 and the distal end of the pin 74. The blocking means 8 has at least one bearing aperture 83, which is designed to be mounted in a rotatable manner on the shaft 78. Depending on the design of the folding clasp 1 and on the position of the brackets 3 and 4, the bearing aperture 83 can be provided on the shaft 78. In this case, the bearing aperture 83 has two bearing openings, which are arranged on the shaft 78, on either side of the second bracket 4. This allows stable mounting of the blocking means. The at least one bearing aperture is advantageously arranged in a region of the shaft 78 in which the second bracket 4 is not mounted on the shaft 78. This means that the folding clasp 1 will not be much thicker, despite the additional blocking means 8. The above described manner of fastening the blocking means 8 on the existing shaft 78 of the second fastening mechanism 7 is particularly advantageous since this makes it possible for the blocking means 8 to be straightforwardly retrofitted in a large number of existing folding clasps 1.

The blocking means 8 preferably has a blocking aperture 84, which is designed to block the distal end of the pin 74. The distal end of the pin 74 is preferably formed such that, once the pin 74 has been introduced into the blocking aperture 84, the distal end of the pin 74 provides blocking in the axial direction of the pin 74. Therefore, the pin 74 has a step, which forms a blocking surface which is oriented away from the distal end of the pin 74. In this case, said step/stop surface is realized by a mushroom-shaped distal end of the pin 74. However, it would also be possible to provide a groove around the pin 74, said groove providing blocking in the blocking aperture 84. The groove thus likewise forms a step, the groove wall forming the stop surface along with the surface normal which is oriented away from the distal end of the pin 74. Other shapes of the pin 74 are also conceivable, for example a T-shaped, anchor-shaped or double-hook-shaped design of the end of the pin 74, which, with appropriate orientation, performs the same function as the pin 74 with a mushroom-shaped end. However, the mushroom-shaped end is particularly advantageous since, at the same time, it achieves blocking in the watch strap 2 (if the distal end of the pin 74 has not been blocked by the blocking means 8). The blocking aperture 84 has preferably at least one movable and/or deformable retaining element. The retaining element is preferably the periphery, for example peripheral regions, of the blocking aperture 84. The retaining element is designed so that, in the rest state, it retains the distal end of the pin 74 in the blocked state and/or it does not allow the distal end of the pin 74 through the blocking aperture 84. The retaining element is designed so that, when the distal end of the pin 74 exerts pressure (in the axial direction of the blocking aperture 84 or of the pin 74), said retaining element moves and/or deforms (out of the rest state) such that the blocking aperture 84 is increased in size and the distal end of the pin 74 can be introduced into the blocking aperture 84.

The blocking aperture 84 is realized preferably by two leaf-spring elements 81, 82 arranged opposite one another. The leaf-spring elements 81, 82 are arranged roughly (with the exception of the curvature, which will be described at a later stage in the text) in a common plane. The leaf-spring elements 81, 82 extend preferably along the longitudinal axis of the folding clasp 1 and/or at right angles to the axis of rotation 77 and/or from the outside to the inside (toward the center) in the direction of the axis of rotation 77. As a result of extending in the direction of the axis of rotation 77 (from the outside to the inside), an axial pressure on the blocking aperture 84 causes rotation or curvature of the leaf-spring element 81, 82 about an axis of rotation or axis of curvature which is located parallel to the longitudinal axis of the blocking means 8 (and along the lateral periphery). The blocking aperture 84 is therefore increased in size. As a result of extending in the direction of the longitudinal axis, the blocking aperture 84 is positioned in relation to the pin 74. When the folding clasp 1 is in the closed state, the longitudinal axis of the blocking means 8 is roughly parallel to the longitudinal axis of the folding clasp 1, to the longitudinal axis of the second bracket 4 and/or to the longitudinal axis of the watch strap 2. The two leaf-spring elements 81 and 82 are formed such that they are separated by a gap 85, through which the distal end of the pin 74 does not fit. This gap 85 opens in the direction of the blocking aperture 84. The gap 85 extends in the longitudinal direction of the blocking means 8. The blocking aperture 84 narrows toward the gap 85 at both ends in the longitudinal direction of the blocking means 8. The blocking aperture 84 has preferably an elongate extent in the longitudinal direction of the blocking means 8. The gap 85 widens in the direction of the axis of rotation 77 and/or in the direction of the at least one bearing aperture 83. Widen here means that the distance between the two leaf-spring elements 81 and 82 becomes larger. The widening 86 can take place continuously or abruptly. This widening preferably provides for the leaf-spring elements to extend parallel to the axis of rotation 77. Following this widening 86, the two leaf-spring elements 81 and 82 are connected to one another preferably via a connecting crosspiece 87. The two leaf-spring elements 81 and 82 are, preferably the entire blocking means 8 is, preferably formed from a single leaf spring. The blocking means 8, the leaf-spring elements 81, 82 and/or the leaf spring has a curvature along the longitudinal axis of the blocking means 8 (see FIG. 6). This curvature improves the spring action and therefore the functionality of the blocking means. At the same time, this curvature makes it possible for the blocking means 8 to be better adapted to the shape of the first and/or second bracket 3, 4 and therefore for space to be saved. Determination of the extent of the curvature of the blocking means 8 can depend on various factors, e.g.: on the material selected and on the size of, in particular the thickness selected for, the blocking means 8 in conjunction with the strength and shape of the watch strap 22. The radius of the curvature of the blocking means 8 is selected preferably to be of an order of magnitude such that, as seen laterally, it is barely perceptible, but nevertheless ensures the aforementioned functionality of the blocking means 8. It should also be noted here that, depending on the configuration of, and material selected for, the blocking means 8, in dependence on the strength selected for the watch strap 22, the curvature of the upper part and the curvature of the lower part of said blocking means 8 run preferably at a certain distance apart and parallel (FIG. 6), but also can be shifted at a certain distance apart and at a minimal angle in relation to one another, in order to ensure functionality. It is also the case that the at least one bearing aperture 83 is preferably formed by the leaf spring. The blocking means 8 can thus be produced from a metal, preferably from a flat-rolled metal, for example metal sheet or metal strip. It is possible for the blocking means 8 to be (hot- or cold-) formed, e.g. punched, cut, bent, drawn or angled, from the above described metal. The curvature and/or the at least one bearing aperture 83 is achieved by cold or hot forming of the metal. As an alternative, it is, of course, also possible to use other manufacturing methods, for example the machining of a workpiece, in particular the machining of blank bar material on automatic lathes or in milling centers. Sintering (modification of materials by means of pressure and heat) is a further possible forming method for producing the blocking means 8, wherein fine-grain ceramics, metallic substances, etc., are heated and modified, and changed in shape, under increased pressure. Furthermore, it is also, of course, possible to use other flexible or deformable materials, e.g. plastic, rubber (e.g. vulcanized rubber) or composites for example made of carbon fibers, etc. Also injection molding or 3D printing are possible methods for producing such blocking means. There is no limit to what a person skilled in the art can use here. The periphery of the blocking aperture 84 is preferably rounded or beveled, in order to make it easier for the distal end of the pin 74 to be introduced into the blocked state and/or guided out of the same.

The above described embodiment of the blocking aperture 84 is particularly advantageous. However, it is also possible for other blocking apertures to be provided. It is thus possible, for example, to use a blocking aperture 84 which has an introduction region and a blocking region. The pin 74 can then be introduced into the introduction region and, for blocking purposes, moved into the blocking region. However, such a blocking aperture 84 requires a more complex movement mechanism. It is also possible to use other blocking mechanisms instead of a blocking aperture 84.

The above described blocking means 8 is particularly advantageous since it allows retrofitting of most of the existing folding clasps 1. All that is required is for the blocking means 8 to be fitted on the folding clasp 1, and the problems of the prior art are easily overcome. This is particularly straightforward if the blocking means 8, as described above, has been mounted on the shaft 78. All that is thus required is for the shaft 78 of the existing folding clasp 1 to be removed. This is a straightforward task on account of the spring bars which are often, albeit not exclusively, used. Thereafter, the blocking means 8 is pushed onto the shaft 78 which has been removed. The shaft 78, with the retrofitted blocking means 8, can then be introduced into the second fastening mechanism 7 again.

The invention claimed is:

1. A folding clasp for a wristwatch, having a first bracket and a second bracket, wherein the first bracket has a first fastening mechanism for fastening a watch strap or a watch housing of the wristwatch, wherein the second bracket has a second fastening mechanism for fastening the watch strap of the wristwatch, wherein the first bracket and the second bracket are connected to one another in a movable manner, and therefore the first and the second brackets can be moved relative to one another between an open state and a closed state of the folding clasp, wherein the folding clasp has a closure mechanism, in order to retain the first and the second brackets in the closed state, wherein the second fastening mechanism has a protruding pin, which is designed to be guided through the watch strap, in order to fasten the watch strap in different axial positions in the second fastening mechanism; the improvement comprising the second fastening mechanism having a blocking means, which is designed to retain the distal end of the pin, the pin being guided through the watch strap, in such a manner that the watch strap is blocked on the pin in the open state of the folding clasp.

2. The folding clasp as claimed in claim 1, wherein the second fastening mechanism has a frame for the watch strap, wherein the pin protrudes out of the frame.

3. The folding clasp as claimed in claim 2, wherein the frame has a first side with the pin, and two lateral sides.

4. The folding clasp as claimed in claim 3, wherein the blocking means and the first side of the frame are arranged such that the watch strap can be guided through between the blocking means and the first side of the frame, wherein preferably the pin is arranged such that it can extend through the watch strap, from the first side of the frame, and the distal end of the pin is retained by the blocking means in such a way that, in the open state of the folding clasp, the watch strap is blocked on the pin.

5. The folding clasp as claimed in claim 3, wherein, in a state in which it is blocking the distal end of the pin, the blocking means is arranged basically parallel to the first side of the frame.

6. The folding clasp as claimed in claim 3, wherein the second fastening mechanism, in particular the frame with its two lateral sides, is fastened on the second bracket such that it can be rotated about an axis of rotation.

7. The folding clasp as claimed in claim 6, wherein the second fastening mechanism, in particular the frame with its two lateral sides, and/or the second bracket are/is mounted on a shaft running along the axis of rotation.

8. The folding clasp as claimed in claim 7, wherein the blocking means is arranged on the shaft, and/or around the axis of rotation, such that it can be rotated in relation to the pin and/or to the second bracket.

9. The folding clasp as claimed in claim 3, wherein the second fastening mechanism, in particular the frame with its two lateral sides, possibly together with the second bracket and/or with the shaft, forms a closed through-passage for the watch strap, through which the watch strap can be guided along the longitudinal axis of the watch strap, in order for the watch strap to be fastened in different axial positions by the pin.

10. The folding clasp as claimed in claim 1, wherein the blocking means is arranged in a movable manner, in particular in a rotatable manner, relative to the pin, and therefore the blocking means can be moved, in particular rotated, between a blocked state, in which the distal end of the pin is blocked by the blocking means, and an open state, in which the distal end of the pin is free.

11. The folding clasp as claimed in claim 1, wherein the blocking means has a blocking opening, which is designed to accommodate, and to retain, the distal end of the pin.

12. The folding clasp as claimed in claim 11, wherein the blocking opening has a movable and/or deformable peripheral region, which, when the distal end of the pin pushes against the blocking opening, moves and/or deforms such that the blocking opening is increased in size.

13. The folding clasp as claimed in claim 11, wherein the blocking opening is formed by two leaf-spring elements arranged opposite one another.

14. The folding clasp as claimed in claim 13, wherein the two leaf-spring elements is formed from the same leaf spring.

15. The folding clasp as claimed in claim 13, wherein the blocking means forms at least one eyelet for the rotatable mounting of the leaf-spring element on a shaft made of the same leaf spring.

16. The folding clasp as claimed in claim 1, wherein the first bracket has a first end and a second end, wherein the second bracket has a first end and a second end, wherein the first end of the first bracket is connected in a rotatable manner to the first end of the second bracket, wherein the first fastening mechanism is arranged at the second end of the first bracket, wherein the second fastening mechanism is arranged at the second end of the second bracket.

17. The folding clasp as claimed in claim 1, wherein the second fastening mechanism has a frame for the watch strap, wherein the pin protrudes from the frame, wherein the frame has a first side, with the pin, and two lateral sides, wherein the pin protrudes from the first side of the frame in the direction of the second bracket, wherein the closure mechanism is independent of the blocking means, in order to retain the first and the second brackets in the closed state.

18. The folding clasp as claimed in claim 17, wherein the blocking means is arranged between the second bracket and the frame.

19. A wristwatch having a watch strap and a folding clasp as claimed in claim 1.

20. A method for retrofitting a folding clasp for a wristwatch, wherein the folding clasp has a first bracket and a second bracket, wherein the first bracket has a first fastening mechanism for fastening a watch strap or a watch housing of the wristwatch, wherein the second bracket has a second fastening mechanism for fastening the watch strap of the wristwatch, wherein the first bracket and the second bracket are connected to one another in a movable manner, and therefore the first and the second brackets can be moved relative to one another between an open state and a closed state of the folding clasp, wherein the folding clasp has a closure mechanism, in order to retain the first and the second brackets in the closed state, wherein the second fastening mechanism has a protruding pin, which is designed to be guided through the watch strap, in order to fasten the watch strap in different axial positions in the second fastening mechanism, the improvement comprising:

retrofitting a blocking means in the second fastening mechanism, wherein the blocking means is designed so that the distal end of the pin guided through the watch strap is thereby retained such that, in the open state of the folding clasp, the watch strap is blocked on the pin.

21. The method as claimed in claim 20, wherein the folding clasp has a shaft, onto which the second bracket and the second fastening mechanism are mounted such that they can be rotated relative to one another, wherein the retrofitting step has the following steps:

removing the shaft;

fitting the blocking means on the shaft; and installing the shaft with the blocking means fitted.

22. A folding clasp for a wristwatch, having a first bracket and a second bracket, wherein the first bracket has a first fastening mechanism for fastening a watch strap or a watch housing of the wristwatch, wherein the second bracket has a second fastening mechanism for fastening the watch strap of the wristwatch, wherein the first bracket and the second bracket are connected to one another in a movable manner, and therefore the first and the second brackets can be moved relative to one another between an open state and a closed state of the folding clasp, wherein the folding clasp has a closure mechanism, in order to retain the first and the second brackets in the closed state, wherein the second fastening mechanism has a protruding pin, which is designed to be guided through the watch strap, in order to fasten the watch strap in different axial positions in the second fastening mechanism; the improvement comprising the second fastening mechanism having a blocking means, which is designed to retain the distal end of the pin, the pin being guided through the watch strap, in such a manner that the watch strap is blocked on the pin in the open state of the folding clasp and wherein the blocking means has a blocking opening, which is designed to accommodate, and to retain, the distal end of the pin.

* * * * *